US010737818B2

(12) United States Patent
Lau et al.

(10) Patent No.: US 10,737,818 B2
(45) Date of Patent: Aug. 11, 2020

(54) PACKING ASSEMBLY

(71) Applicant: Multivac Sepp Haggenmüller GmbH & Co. KG, Wolfertschwenden (DE)

(72) Inventors: Christian Lau, Heimenkirch (DE); Thomas Fickler, Westerheim (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 1121 days.

(21) Appl. No.: 14/954,452

(22) Filed: Nov. 30, 2015

(65) Prior Publication Data

US 2016/0159510 A1 Jun. 9, 2016

(30) Foreign Application Priority Data

Dec. 3, 2014 (EP) ..... 14196120
Sep. 17, 2015 (EP) ..... 15185569

(51) Int. Cl.
*B65B 57/12* (2006.01)
*B65B 59/00* (2006.01)
(Continued)

(52) U.S. Cl.
CPC ..... *B65B 57/12* (2013.01); *B07C 5/08* (2013.01); *B07C 5/3422* (2013.01); *B65B 9/045* (2013.01); *B65B 25/06* (2013.01); *B65B 31/04* (2013.01); *B65B 35/10* (2013.01); *B65B 35/24* (2013.01); *B65B 47/00* (2013.01); *B65B 47/02* (2013.01); *B65B 51/26* (2013.01); *B65B 57/06* (2013.01); *B65B 57/14* (2013.01); *B65B 59/00* (2013.01); *B65B 65/003* (2013.01); *B07C 2501/0081* (2013.01); *B65B 2210/02* (2013.01); *B65B 2210/04* (2013.01)

(58) Field of Classification Search
CPC ..... B65B 57/12; B65B 9/045; B65B 25/06; B65B 31/04; B65B 35/10; B65B 35/24; B65B 47/00; B65B 47/02; B65B 51/26; B65B 57/06; B65B 57/14; B65B 59/00; B65B 2210/04; B07C 5/08; B07C 5/3422; B07C 2501/0081
USPC ..... 53/453; 493/143, 158, 453
See application file for complete search history.

(56) References Cited

U.S. PATENT DOCUMENTS 3,667,971 A * 6/1972 Brunner ..... B65B 9/06 426/282
3,750,362 A * 8/1973 Kishpaugh ..... B65B 31/021 206/525
(Continued)

FOREIGN PATENT DOCUMENTS

CN 101641259 A 2/2010
CN 101962087 A 2/2011
(Continued)

*Primary Examiner* — Sameh Tawfik
(74) *Attorney, Agent, or Firm* — Husch Blackwell LLP

(57) ABSTRACT

The present invention relates to a packaging assembly and a method of packaging differently sized products, such as fresh meat cuts. The packaging assembly can include at least one thermoform packaging machine having at least two forming stations. The thermoform packaging machine can also include a control unit configured for providing, during operation and in a manner that is automatically adaptable in response to the supplied products, formats with a first or a second number of troughs for placing the respective products thereinto.

10 Claims, 4 Drawing Sheets

(51) Int. Cl.

| | |
|---|---|
| ***B65B 47/00*** | (2006.01) |
| ***B65B 9/04*** | (2006.01) |
| ***B07C 5/342*** | (2006.01) |
| ***B65B 51/26*** | (2006.01) |
| ***B65B 57/14*** | (2006.01) |
| ***B65B 25/06*** | (2006.01) |
| ***B65B 31/04*** | (2006.01) |
| ***B65B 57/06*** | (2006.01) |
| ***B65B 35/24*** | (2006.01) |
| ***B65B 65/00*** | (2006.01) |
| ***B07C 5/08*** | (2006.01) |
| ***B65B 35/10*** | (2006.01) |
| ***B65B 47/02*** | (2006.01) |

(56) References Cited

U.S. PATENT DOCUMENTS 3,956,867 A * 5/1976 Utz ..... B65B 9/04 53/433
4,120,984 A * 10/1978 Richardson ..... A21B 7/00 426/128
4,168,598 A * 9/1979 Omori ..... B65B 31/021 53/433
4,209,957 A * 7/1980 Utzmann ..... B29C 51/18 264/101
4,538,396 A * 9/1985 Nakamura ..... B65D 75/5827 53/412
4,576,286 A * 3/1986 Buckley ..... B07C 5/02 209/558
4,656,042 A * 4/1987 Risler ..... A23B 7/01 220/506
5,025,611 A * 6/1991 Garwood ..... B65B 11/50 426/324
5,101,611 A * 4/1992 Biskup ..... B29C 49/0047 425/504
5,129,512 A * 7/1992 Garwood ..... B65D 81/24 206/213.1
5,406,770 A * 4/1995 Fikacek ..... B65B 5/105 53/155
5,495,705 A * 3/1996 Miura ..... B65D 75/327 53/411
5,524,419 A * 6/1996 Shannon ..... B29C 33/36 264/1.1
5,765,345 A * 6/1998 Svec ..... B29C 51/267 53/453
6,104,966 A * 8/2000 Haagensen ..... A22B 5/007 221/1
6,164,174 A * 12/2000 Sigurdsson ..... A22C 25/18 83/13
6,533,125 B1 3/2003 Jensen
6,546,304 B2 * 4/2003 Thorvaldsson ..... A22B 5/0064 700/115
6,996,948 B2 * 2/2006 Koke ..... B65B 25/065 53/459
7,004,346 B2 * 2/2006 Schwab ..... B65B 9/042 220/359.2
7,261,130 B2 * 8/2007 Porter ..... B65B 25/06 141/129
7,383,695 B2 * 6/2008 Lehman ..... C03B 1/00 209/930
8,091,712 B2 * 1/2012 Thorsson ..... G01G 19/303 209/559
8,281,559 B2 * 10/2012 Ehrmann ..... B29C 65/08 53/433
8,352,068 B2 * 1/2013 Gudjonsson ..... A22C 17/0093 700/223
8,544,245 B2 * 10/2013 Ehrmann ..... B65B 7/164 53/559
8,663,080 B2 * 3/2014 Bartoli ..... B65B 9/042 493/52
8,783,438 B2 * 7/2014 Phan ..... A47F 9/04 186/61
9,919,825 B2 * 3/2018 Ewert ..... B65B 59/02
2003/0036344 A1 * 2/2003 Sigurdsson ..... A22C 17/0086 452/150
2006/0113715 A1 * 6/2006 Schwab ..... B29C 51/26 264/523
2009/0025340 A1 * 1/2009 Natterer ..... B65B 9/04 53/433
2015/0367971 A1 * 12/2015 Grimm ..... B65B 31/021 53/453
2018/0273225 A1 * 9/2018 Ehrmann ..... B29C 65/18
2019/0021953 A1 * 1/2019 Ravussin ..... B65B 51/22

FOREIGN PATENT DOCUMENTS

| | | | |
|---|---|---|---|
| DE | 102010053872 | A1 | 6/2012 |
| EP | 1041006 | A2 | 10/2000 |
| EP | 1234765 | A1 | 8/2002 |
| EP | 2692646 | A1 | 2/2014 |
| FR | 2975081 | A1 | 11/2012 |
| WO | 2002016210 | A1 | 2/2002 |

* cited by examiner

PACKING ASSEMBLY

CROSS-REFERENCE TO RELATED APPLICATIONS

This Application claims priority to European Patent Application Number 14196120.1 filed Dec. 3, 2014, to Christian Lau et al., currently pending, and to European Patent Application Number 15185569.9, filed Sep. 17, 2015, to Christian Lau et al., currently pending. The entire disclosures of each of the above-cited applications are incorporated herein by reference.

FIELD OF THE INVENTION

The present invention relates to a packaging assembly and a method of packaging differently sized products.

BACKGROUND OF THE INVENTION

WO 2002/016210 A1 discloses a packaging line for packing meat cuts in bags. In the packaging line, the individual meat cuts, which differ primarily with respect to their size, are sensed by an information acquisition stage and then fed to a packaging station. At the packaging station, a bag suiting the size of the meat cut is provided and the meat cut is packed. In the case of an embodiment comprising a plurality of packaging stations, the information acquisition stage is followed by a meat-cut distributing unit used for distributing the meat cuts to the various packaging stations based on, for example, the size of the meat cuts. Disadvantages of such a bag packaging assembly are the limited capacity of the assembly and the optical appearance of a bag package.

SUMMARY OF THE INVENTION

The object of the present invention to provide an improved packaging assembly and a method of operating the packaging assembly.

The packaging assembly according to one embodiment of the present invention can be used for packaging differently sized products, including foodstuffs and in particular fresh meat cuts. The packaging assembly can comprise a feed unit for the products, which can have at least one distinguishable product feature. The packaging assembly can additionally comprise an examining station for sensing the at least one product feature and a distributor for distributing the products to at least two conveyors. The packaging assembly according to one embodiment of the present invention is characterized in that at least one thermoform packaging machine comprising a first and a second forming station is provided. The first forming station can be adapted for forming (i.e. thermoforming) film web troughs of a first size and the second forming station can be adapted for forming (i.e., thermoforming) film web troughs of a second size that differs from the first size. The thermoform packaging machine can comprise a control unit configured for providing, during operation and in a manner that is automatically adaptable in response to the supplied products, a first or a second size of troughs for placing the respective products thereinto. This can allow automated packaging of differently sized products, such as fresh meat cuts, in troughs suitably dimensioned for the respective product conveyed to the thermoform packaging machine. The differently sized troughs can be produced in accordance with the supplied products and automatically provided at an infeed station, which can allow for efficient performance of the packaging assembly. The size of a trough can be defined by the length, width and/or depth of the depression formed in the film web in the forming station. The products provided for a respective trough can have a smaller length, width and height than the trough itself. A format can be defined by the number and/or the shape of a group of troughs produced during a common forming process. A format can also correspond approximately to the dimensions of the forming tool and can have a length that corresponds to the intermittent advance movement of the film web.

According to one embodiment of the present invention, a first sealing station is provided for sealing a format, which comprises one or a plurality of troughs, with a cover film by means of at least one frame seal. The frame seal, which can consist of a closed sealed seam extending circumferentially on the outer side of the format, can ensure that, in the interior of the package comprising one or a plurality of products, a modified atmosphere (e.g., an inert gas atmosphere) remains intact for the additional process steps.

According to one particular embodiment of the present invention, the thermoform packaging machine comprises a second sealing station for producing a transverse and/or longitudinal seal, so as to seal two troughs, which have already been formed within a format, such that two independent packages are obtained.

According to one embodiment of the invention, the second sealing station is arranged in a conveying direction downstream of the first sealing station, since, on the basis of this configuration, the modified atmosphere, which has been generated in the first sealing station, remains intact and no further measures with respect to the atmosphere in the packages have to be taken.

One or more of the conveyors can comprise a buffer for taking up one or a plurality of products from the conveyor and for re-transferring the product or products to the conveyor with a time shift (delay). Products of a first grade, which need not succeed one another in the conveying direction but can be separated by a product of some other grade, can thus can be brought together in the sense that the number of identical products required for a format can be supplied to the infeed station as a group. The products supplied on the feed unit in an arbitrary sequence can thus easily be sorted or grouped in accordance with the formats provided therefor.

The control unit can be configured for tracking the respective current position of the products from the examining station along the feed unit, the conveyors and (if provided) the buffer up to and into the thermoform packaging machine (referred to as "product tracking" hereinbelow), so as to allow for the forming stations to form suitable troughs, which can be supplied to the infeed station simultaneously with the products provided for these troughs. The change between the two or more different formats and the different numbers of troughs, respectively, can thus take place without any film web losses (e.g., without any so-called idle cycles).

The control unit can be, as a control unit of the whole packaging assembly, a part of the machine control unit of a thermoform packaging machine and can transmit information originating, for example, from the examining station to a further thermoform packaging machine. The control of the forming stations within the respective thermoform packaging machine can be effected via the respective machine control unit, whereas product tracking after the examining station along the conveyors can be effected by means of the control of the whole packaging assembly.

According to one special embodiment of the present invention, a respective collecting unit is arranged downstream of the conveyors so as to take up products from the conveyors before the products are fed in. Complicated control processes, such as control of the speed of the individual conveyors, are thus no longer necessary, since by means of the collecting units, it can be guaranteed that a sufficiently large number of products required for feeding in will always be available at the infeed station.

A method according to one embodiment of the present invention used for operating a packaging assembly, which can include at least one thermoform packaging machine, a feed unit for products and an examining station can comprise the steps of (i) ascertaining at least one product feature of each product by the examining station provided, for example, at, along or on the feed unit, and (ii) distributing the product then by means of a distributor to a conveyor in accordance with the product feature ascertained. The method can be characterized in that, by means of at least two forming stations of a thermoform packaging machine and by means of a control unit communicating with the examining station, a suitable size of and/or number of troughs is formed into a film web depending on the products sensed at the examining station and in accordance with the ascertained product features of said products. This can allow a fully automated operation of a packaging assembly when arbitrarily supplied products differing from one another with respect to a product feature (e.g., the size of the product) can be placed into troughs specially provided for the various product features, and packed in a modified atmosphere such that an optically pleasing thermoformed package can be obtained. In particular, for products consisting of fresh meat cuts, a longer shelf life can be accomplished by gas flushing in the case of thermoform packages in comparison with bag packages.

According to a particular embodiment of the present invention, the product feature consists of at least one dimension of the product, such as its height, its length and/or its width. The troughs produced in a forming station may have a predetermined length and width, while the depth of the trough can be adapted to the height of the product in the manner known.

Preferably, the distributor can distribute the products to the respective conveyor in accordance with their product feature, so as to allow sorting and/or a formation of groups in a simple way.

According to one specific embodiment, the products positioned on the conveyor are buffered at a collecting unit prior to taking the product from the collecting unit at the infeed station and placing it into the trough. The conveyors and product tracking can thus be controlled more easily.

According to one specific embodiment, individual products or a plurality of products are taken up from the conveyor by means of a buffer and are then re-transferred to the conveyor so as to form groups of the products provided for a format.

The products or the position of the products can be tracked by means of the control unit from the examining station, along the feed unit, through the conveyors and the buffer, and up to and into the thermoform packaging machine (product tracking), so as to control and coordinate the forming stations in accordance with the position and the conveying progress of the individual products.

The products, which can differ from one another with respect to a product feature, can be jointly conveyed on a conveyor up to the infeed station of the thermoform packaging machine, and the respective format or trough provided for the product in question can be formed by means of one of two forming stations and brought together with the associated product in the infeed station.

According to an expedient embodiment of the present invention, each individual section of the film web for the troughs is thermoformed into a trough at precisely one of the forming stations, i.e., a section that has already been thermoformed in the first forming station can be conveyed through the subsequent forming station(s) without being deformed. It can be of advantage when beyond the last forming station each section of the film web has been formed into a trough.

In the packaging assembly according to one embodiment of the present invention and in accordance with the method according to one embodiment of the present invention, the examining station may comprise an automatically operating examining unit for sensing the at least one product feature. Additionally or alternatively, the examining station may comprise an input unit, such as a keyboard, a touchscreen or the like, where an operator can select or input a product feature that has been determined by him optically or manually. This input unit can then communicate with the machine control unit of the packaging machine for transmitting the inputted or outputted product features.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Like elements are provided with like reference numerals throughout the drawings.

DETAILED DESCRIPTION OF THE INVENTION

Figure 1A:
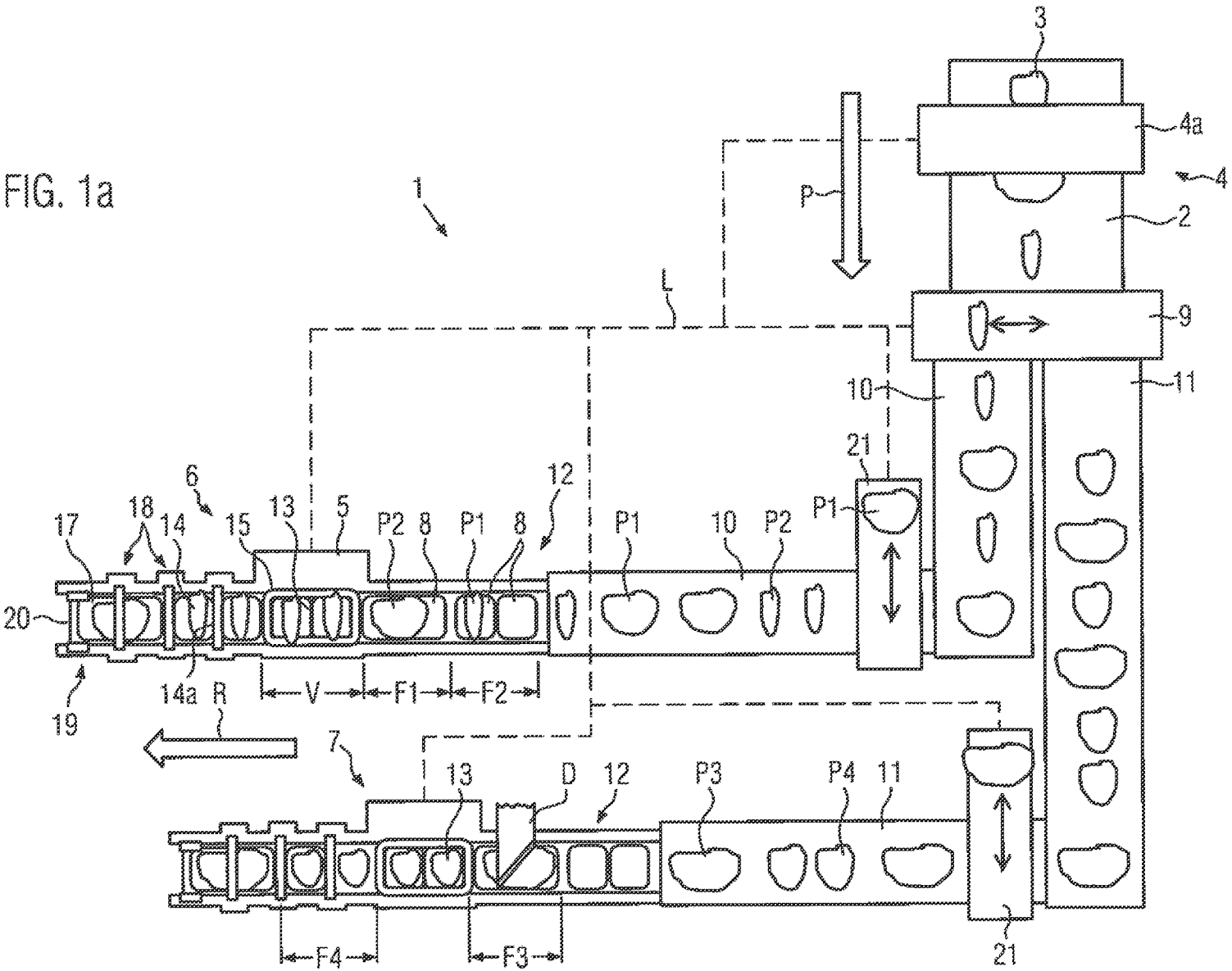
FIG. 1*a* is a schematic plan view of a packaging assembly according to one embodiment of the present invention.

The invention will now be described with reference to the drawing figures, in which like reference numerals refer to like parts throughout. For purpose of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1*a* shows a packaging assembly 1 according to one embodiment of the present invention comprising a feed unit 2 conveying differently sized products 3 (such as but not limited to fresh meat cuts) past or below an examining station 4 in a production direction P indicated by an arrow. The examining station 4 may comprise a CCD camera, a vision system and/or an X-ray unit as an examining unit 4*a* sensing at least one product feature (i.e., a characteristic of the product). According to one embodiment of the present invention, examining unit 4*a* can sense/detect the size, and in particular the length and the width and/or other external dimensions of the products 3 as a product feature and transmit these product features via data and control lines L to a machine control unit 5 of a thermoform packaging machine 6 located downstream, when seen in the production direction P. Other product features may be the volume or the weight of the product 3. If the weight is the product feature in question, the examining unit 4*a* may be a weighing scale. It is also imaginable to sense the products 3 that are provided with a barcode, by means of a scanner as an examining unit 4*a* at the examining station 4 with respect to their product feature.

In addition, it is imaginable to provide a combination of different examining units 4*a* so as to sense a plurality of product features. The machine control unit 5 of the thermoform packaging machine 6 can constitute here also the control unit 5 of the packaging assembly 1 in its entirety.

Figure 1B:
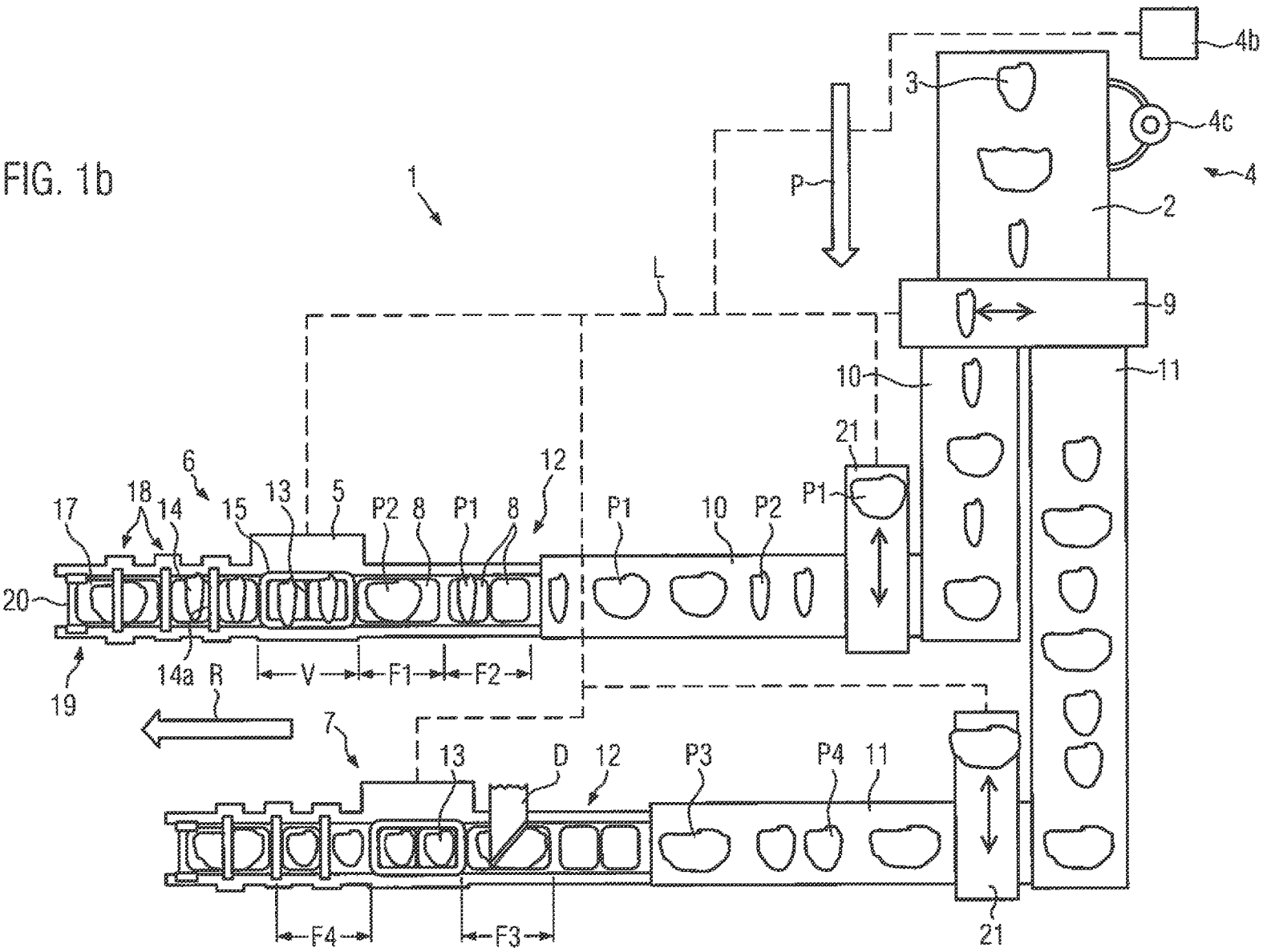
FIG. 1*b* is a schematic plan view of an alternative packaging assembly according to one embodiment of the present invention.

FIG. 1*b* shows an alternative embodiment of the examining station 4 where an operator 4*c* is provided at the examining station 4, in addition to or instead of the examining unit 4*a*, for examining the products 3 and for selecting or inputting the respective product feature at an input unit 4*b* of the examining station 4. The input unit 4*b* can communicate with the machine control unit 5 of the thermoform packaging machine 6.

FIGS. 1*a* and 1*b* show a first thermoform packaging machine 6 and a second thermoform packaging machine 7, each of which can have the capability to produce two different formats F1/F2 and F3/F4, respectively, of thermoformed troughs 8 in an arbitrary sequence. In one embodiment, the first format F1, F3 can be a single large trough 8 and the second format F2 or F4 can comprise two troughs 8. The opening areas of the two troughs 8 of the second format F2 each can correspond to approximately half the opening area of the trough 8 of the first format F1. The total of four formats F1, F2 or the four different sizes of troughs 8 that can be provided in the packaging assembly 1 can be able to accommodate four differently sized products P1 to P4. According to one embodiment of the present invention, the different grades of products 3 are identified, according to their size and assignment, by P1, P2, P3 and P4, the products 3 of grades P1 and P2 being provided for the formats on the first thermoform packaging machine 6 and the products 3 of grades P3 and P4 being provided for the formats on the second thermoform packaging machine 7.

According to one particular embodiment, the products 3 of grade or type P1 can have a length of 20-30 cm and a width of 10-15 cm. The products 3 of the second grade P2 can have a "length" of only 3-5 cm and a "width" of 10-15 cm similar to that of the products of the first grade P1. The products of the third grade P3 can have a length of 30-40 cm and a width of 10-15 cm similar to that of the products of all the other grades. The products of the fourth grade P4 can have a "length" of 15-20 cm and a "width" of 10-15 cm. In other embodiments of the present invention, it is imaginable to differentiate between the products 3 not only on the basis of a single dimension (e.g., length, height or width), but also on the basis of their dimensions in two or more directions in space. For example, different product grades P1 to P4 can be differentiated on the basis of the sum of the dimensions in two or three different directions in space. According to other embodiments, it is also imaginable to use, for example, the weight of the products 3 as the only or as an additional distinguishing feature between the various grades P1 to P4. The foregoing embodiments disclosing formats F1-F4 and grades P1-P4 are intended only as exemplary embodiments, and thus, it is certainly anticipated that different types and number of formats and/or grades can be employed in alternative embodiments.

In order to realize the distribution of the products 3 to the two thermoform packaging machines 6, 7, a distributor 9 can be arranged at the end of the feed unit 2. The control unit 5 can control the distributor 9 in accordance with the information received from the examining station 4, the information concerning at least one product feature of each individual product 3. The distributor 9 can ensure that the products 3 are distributed to or assorted onto to a subsequent first 10 and a second conveyor 11. The distributor 9 may be configured, for example, as a picker, an Anaconda belt and/or a gate. The first conveyor 10 may comprise one or, as shown in FIG. 1, two successive conveyors so as to feed the products 3 of grades P1 and P2 to the first thermoform packaging machine 6. Analogously, this can also be the case for the second conveyor 11 and the second thermoform packaging machine 7 and the products 3 of grades P3 and P4.

The products 3 can be conveyed by the conveyors 10, 11 up to infeed stations 12 of the thermoform packaging machines 6, 7 and can be placed, manually or automatically, into the troughs 8 provided at the infeed station 12. The troughs 8 can be produced by means of forming stations 22, 23, which are shown in more detail in FIG. 2. Each individual product 3 can be assigned to the respective trough 8 by the control unit 5. FIGS. 1*a* and 1*b* illustrate one embodiment of the present invention where a product 3 of grade P2 has already been placed into one of the two troughs 8 of the format provided in the infeed station 12 in the first thermoform packaging machine 6. The product 3 arriving next on the first conveyor 10 can be a further product 3 of grade P2 and can complete, after having been inserted, the format F1. Through a subsequent advance movement V of the format F1 in a conveying direction R of the first thermoform packaging machine 6 within a work cycle, the format F2 (e.g., the trough 8 for the product 3 of grade P1) can be provided in the infeed station 12 for placing the product thereinto.

In order to be able to provide the necessary number of products 3 of grades P1 and P2 for a format at the infeed station 12, a respective buffer 21 can be provided at the conveyors 10, 11. The buffer 21 can take up one or a plurality of products 3 from the conveyor 10, 11, so that two mating products 3 of the same grade P2 can successively be supplied to the infeed station 12. This can ensure that not only one product P2 but two products 3 of the same grade P2 are in direct succession, supplied to the format F2 provided therefor. The product P1 stored intermediately on the buffer 21 for a short period of time can be returned to the conveyors 10, 11 for the purpose of sorting the products 3 or forming groups of products 3. This can be caused by the control unit 5 via the control lines L.

By means of further advance movements V, the troughs 8 or formats filled with the product 3 can, together with a cover film D, be supplied to a first sealing station 13. In FIGS. 1*a* and 1*b*, the cover film D is shown only at the second thermoform packaging machine 7 for the sake of clarity; however, the cover film D can be applied at both the first and second thermoform packaging machines 6 and 7. The first sealing station 13 can produce a circumferentially extending seal or frame seal 15, the interior of the resultant package 17 being evacuated and/or gas flushed. If the format F1 consists of only one trough 8, then the package 17 can be finished sealing after frame seal 15. In the case of two troughs 8 per format F2, a second seal 14*a* can be applied in the form of a sealed seam transversely to the conveying direction R in a second sealing station 14 for sealing the products P2 such that individual packages 17 can be formed. Additional sealing stations for creating addition seals can be incorporated in alternative embodiments of the present invention. By means of a cross cutting station 18 and a subsequent longitudinal cutting station 19, the packages can be cut out from a film web 20, into which the troughs 8 have been formed (i.e., thermoformed) and separated from one another.

According to the differences in size of the products 3 of grades P1 and P2 for the first thermoform packaging machine 6, the troughs 8 of the second thermoform packaging machine 7 can be larger in size for the products 3 of grades P3 and P4 when the products 3 for grades P3 and P4 are larger in comparison with the first-mentioned products 3 for grades P1 and P2 in that the film width of the film web 20 is larger and/or the advance movement V per work cycle has a length exceeding that of the advance movement V of the first thermoform packaging machine 6. The advance movement V can be defined by the length of the format in the conveying direction R and the length can be constant in the case of each of the thermoform packaging machines 6, 7, according to one embodiment of the present invention as illustrated in FIGS. 1*a* and 1*b*. According to one specific embodiment of the present invention, the advance movement V can be 400 mm at the first thermoform packaging machine 6 and 600 mm at the second thermoform packaging machine 7. Other dimensions for advance movement V are anticipated in alternative embodiments.

Figure 2:
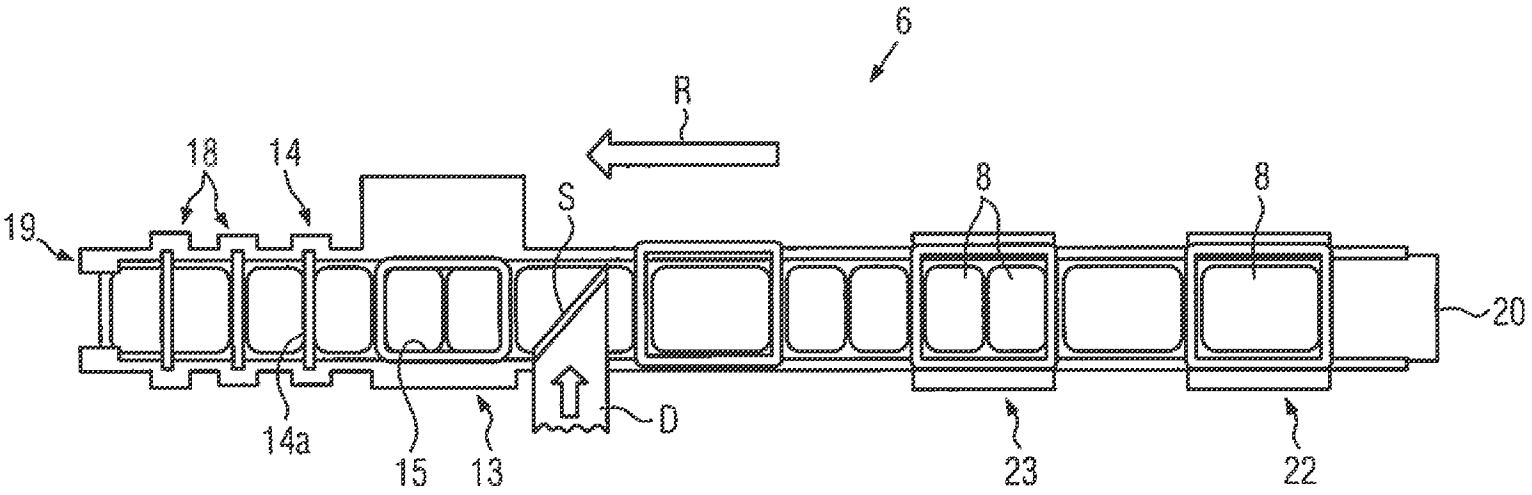
FIG. 2 is a schematic plan view of a thermoform packaging machine according to one embodiment of the present invention.

FIG. 2 shows the thermoform packaging machine 6 and can also be representative of both thermoform packaging machines 6 and 7 in a top view over its entire length. The thermoform packaging machine 6 can include a first forming station 22 for thermoforming a trough 8 into the film web 20 and a second forming station 23 for thermoforming two troughs 8 per format and work cycle, as shown in FIG. 2. The first forming station 22 and second forming station 23 may also be exchanged for one another in certain embodiments. Likewise, the two troughs 8 of the second forming station 23 may be divided not transversely to the conveying direction R into two rows but longitudinally in the conveying direction R into two tracks. The second sealing station 14 can be adapted accordingly and instead of a cross cutting station 18, which would no longer be necessary, the longitudinal cutting station 19 could additionally carry out the division of the two packages 17 and tracks, respectively.

FIG. 2 additionally shows, even more precisely than FIG. 1*a* or 1*b*, how the cover film D can be supplied. In particular, the cover film D can be first supplied at an angle of approximately 90° relative to the conveying direction R. A short distance before the sealing station 13, the cover film D cab then be deflected by approximately 90° at a shoulder S extending at an angle of approximately 45° relative to the conveying direction R. Other angles and deflections may also be suitable as well, After having been deflected at the shoulder S, the cover film D can be, together with the troughs 8, conveyed in the conveying direction R into the sealing station 13.

Figure 3:
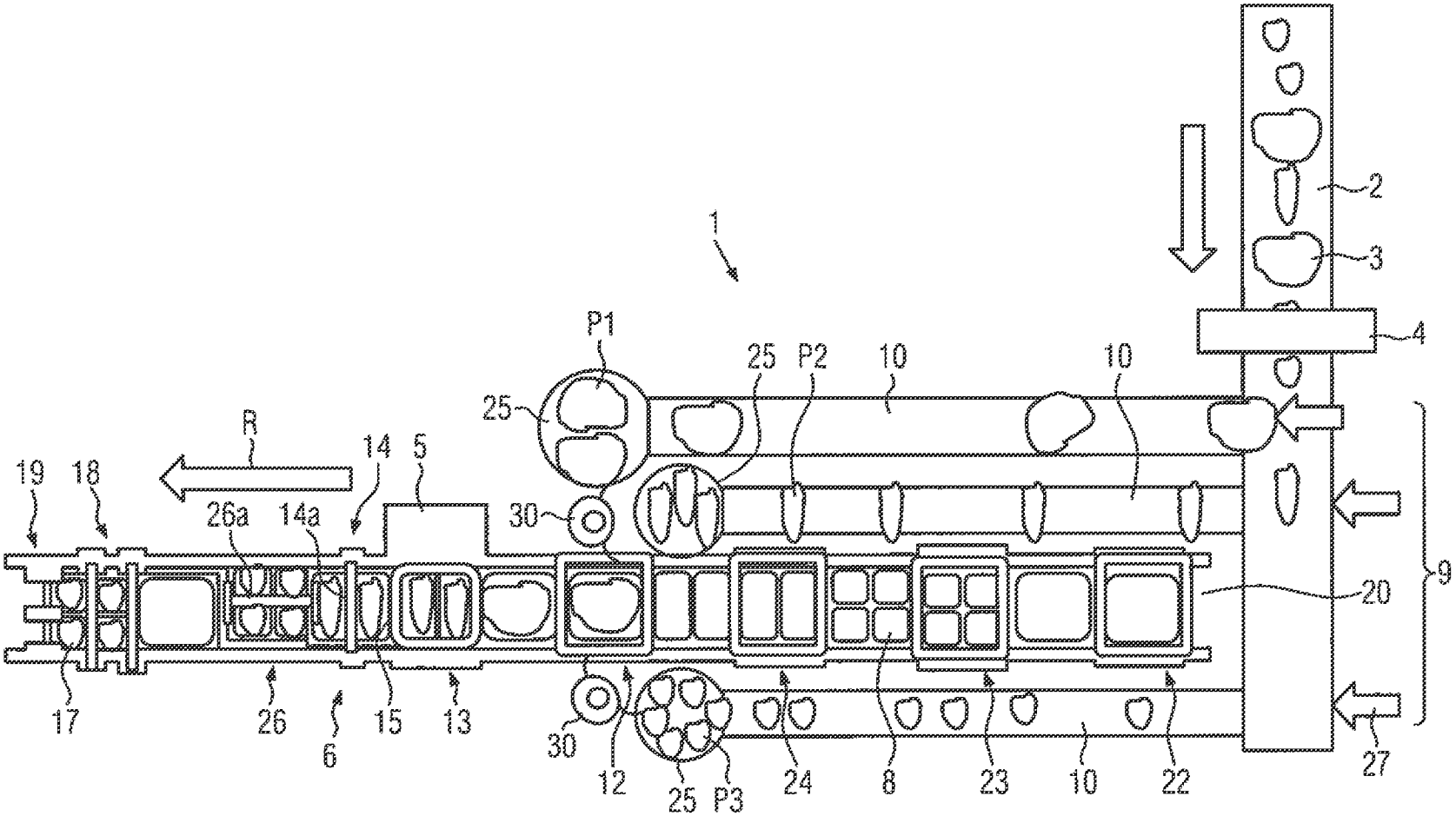
FIG. 3 is a schematic plan view of an alternative packaging assembly according to one embodiment of the present invention.

FIG. 3 shows an alternative packaging assembly 1 according to an alternative embodiment of the present invention. The packaging assembly 1 can differ from the packaging assemblies 1 shown in FIGS. 1*a* and 1*b* insofar as only a single thermoform packaging machine 6 is provided and the products 3 are distributed to a plurality of conveyors 10, such as three conveyors as shown in FIG. 3. The packaging assembly 1 can be adapted for several different grades of products. For example, as shown in FIG. 3, the packaging assembly 1 can be adapted for three different grades of products P1, P2 and P3 and the distributor 9 can distribute the products 3 of grades P1, P2 and P3 to the conveyors 10 such that only one type of product (e.g., P1 or P2 or P3) will be present on the respective conveyor 10. In accordance with the three different types or grades P1, P2 and P3 of products 3, the thermoform packaging machine 6 can comprise, downstream of the first forming station 22 and second forming station 23, a third forming station 24 so as to form into the film web 20 four troughs 8 in the form of two successive and two juxtaposed troughs 8 within the format. The sequence of the three forming stations 22, 23, 24 can be chosen at will. Additionally, in alternative embodiments of the present invention, the packaging assembly 1 can include additional forming stations for addition types of products (P4, P5, etc.).

In the area of the infeed station 12, each of the conveyors 10 can be followed by a collecting unit 25 used for buffering a plurality of products 3. At the infeed station 12, one or two operators 30 (schematically shown in FIG. 3) on either side of the thermoform packaging machine 6 can remove from the collecting unit 25 in question the respective product 3 or products 3 for the format with one, two or four troughs 8 positioned in the infeed station 12, and place the product 3 or products 3 into the trough 8.

Analogously to the three forming stations 22, 23, 24, the thermoform packaging machine 6 can also comprise a first 13, a second 14 and additionally a third sealing station 26 so as to be able to produce packages 17 of the three different formats. More than three or less than three forming stations and sealing stations can also be used in alternative embodiments of the present invention. In the embodiment shown in FIG. 3, the first 13 and the second sealing station 14 are configured in the same way as in FIGS. 1 and 2. The third sealing station 26 can be configured for producing a longitudinal seal 26*a* in the form of an additional sealed seam along the conveying direction R. Furthermore, the thermoform packaging machine 6 can comprise a cross cutting station 18 and a longitudinal cutting station 19. The longitudinal cutting station 19 can be configured to selectively execute a cut centrally in the format in the sealed seam 26*a* that was produced in third sealing station 26.

The packaging assembly 1, according to the embodiment illustrated in FIG. 3, can include, similar to the packaging assembly 1 according to the embodiments shown in FIGS. 1*a* and 1*b*, a feed unit 2 having provided thereon the examining station 4 so as to ascertain the position as well as the product features of the respective products 3 and distribute or transfer the products 3 in accordance with their product features to the respective conveyors 10 by means of one or more pushers 27 of the distributor 9.

Likewise, it is imaginable to provide collecting units 25 at the conveyors 10, 11 of the packaging assembly 1 shown in FIG. 1*a* or 1*b*.

From the foregoing, it will be seen that this invention is one well adapted to attain all the ends and objects hereinabove set forth together with other advantages which are obvious and which are inherent to the structure. It will be understood that certain features and sub combinations are of utility and may be employed without references to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereto, will occur to those skilled in the art. The terms "having" and "including" and similar terms are used in the foregoing specification are used in the sense of "optional" or "may include" and not as "required". Many changes, modifications, variations, and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging assembly for packaging differently sized products, the packaging assembly comprising:

a feed unit for conveying a plurality of products having different sizes to at least one thermoform packaging machine;

an examining station that senses at least one distinguishable product feature of the products, wherein the distinguishable product feature is a size of the product;

a distributor that distributes each product of the plurality of products having different sizes to one of at least two conveyors of the packaging assembly based upon the size of the product; and the at least one thermoform packaging machine comprising:

a first forming station that forms one or more troughs of a first size and a first format into a bottom film web;

a second forming station that forms one or more troughs of a second size and a second format into the bottom film web;

wherein, when formed, the second size and format is adjacent to the first size and format horizontally and in the machine direction; and a control unit controls the operation of the at least one thermoform packaging machine to selectively form either (a) the one or more troughs of the first size or (b) the one or more troughs of the second size automatically in response to a size of the product to coordinate the size of the troughs to the size of each of the plurality of products having different sizes;

a first sealing station that seals at least one of the one or more troughs of the first size and the first format, and the one or more troughs of the second size and the second format in the bottom film with a cover film, wherein the bottom film and the cover film are separate elements.

2. The packaging assembly according to claim 1, wherein the at least one thermoform packaging machine comprises a second sealing station for producing at least one of a transverse seal and a longitudinal seal.

3. The packaging assembly according to claim 2, wherein the second sealing station is arranged in a conveying direction downstream of the first sealing station.

4. The packaging assembly according to claim 1, wherein at least one of the at least two conveyors comprises a buffer that takes up one product or a plurality of products from the at least one of the at least two conveyors and replaces the taken up product or the plurality of products to the at least one of the at least two conveyors for sorting the products or forming groups of the products.

5. The packaging assembly according to claim 1, wherein the control unit tracks the positions of the products from the examining station, along the feed unit and the at least two conveyors, and up to and into the thermoform packaging machine.

6. The packaging assembly according to claim 5, wherein the control unit of the packaging assembly is a machine control unit of the at least one thermoform packaging machine.

7. The packaging assembly according to claim 1, wherein the examining station comprises an input unit for manually selecting a product feature of a product.

8. The packaging assembly for packaging differently sized products of claim 1, further comprising the first sealing station to form a circumferential seal around the one or more troughs of the first format and the one or more troughs of the second format in the bottom film with the cover film using at least one frame seal.

9. The packaging assembly for packaging differently sized products of claim 1, wherein the first format comprises a single trough having a first perimeter, and the second format comprises a plurality of individual troughs within a second perimeter, wherein the first perimeter and the second perimeter are similar, and wherein the first sealing station forms a circumferential seal around the trough of the first format and the troughs of the second format in the bottom film with a cover film using at least one frame seal, wherein the bottom film and the cover film are separate film elements.

10. A packaging assembly for packaging differently sized products, the packaging assembly comprising:

a feed unit for conveying a plurality of products having different sizes to at least one thermoform packaging machine;

an examining station that senses at least one distinguishable product feature of the products, wherein the distinguishable product feature is a size of the product;

a distributor that distributes each product of the plurality of products having different sizes to one of at least two conveyors of the packaging assembly based upon the size of the product; and the at least one thermoform packaging machine comprising:

a first forming station that forms one or more troughs of a first size and a first format into a bottom film web;

a second forming station that forms one or more troughs of a second size and a second format into the bottom film web;

wherein the first format comprises a single trough having a first perimeter, and the second format comprises a plurality of individual troughs within a second perimeter, wherein the first perimeter and the second perimeter are similar, and wherein the first sealing station forms a circumferential seal around the trough of the first format and the troughs of the second format in the bottom film with a cover film using at least one frame seal, wherein the bottom film and the cover film are separate film elements; and a control unit controls the operation of the at least one thermoform packaging machine to selectively form either (a) the one or more troughs of the first size or (b) the one or more troughs of the second size automatically in response to a size of the product to coordinate the size of the troughs to the size of each of the plurality of products having different sizes;

a first sealing station that seals at least one of the one or more troughs of the first size and the first format, and the one or more troughs of the second size and the second format in the bottom film with a cover film, wherein the bottom film and the cover film are separate elements.

* * * * *